US011091339B2

(12) United States Patent
Akahane

(10) Patent No.: US 11,091,339 B2
(45) Date of Patent: Aug. 17, 2021

(54) MEDIUM SUPPORTING DEVICE AND RECORDING DEVICE

(71) Applicant: SEIKO EPSON CORPORATION, Tokyo (JP)

(72) Inventor: Takashi Akahane, Miyada-mura (JP)

(73) Assignee: Seiko Epson Corporation, Tokyo (JP)

( * ) Notice: Subject to any disclaimer, the term of this patent is extended or adjusted under 35 U.S.C. 154(b) by 262 days.

(21) Appl. No.: 16/361,712

(22) Filed: Mar. 22, 2019

(65) Prior Publication Data

US 2019/0291995 A1 Sep. 26, 2019

(30) Foreign Application Priority Data

Mar. 26, 2018 (JP) ..... JP2018-057637

(51) Int. Cl.

| | |
|---|---|
| ***B65H 16/06*** | (2006.01) |
| ***B41J 15/02*** | (2006.01) |
| ***B65H 75/08*** | (2006.01) |
| ***B65H 75/18*** | (2006.01) |
| ***B41J 15/04*** | (2006.01) |

(52) U.S. Cl.

CPC ..... *B65H 16/06* (2013.01); *B41J 15/02* (2013.01); *B41J 15/04* (2013.01); *B65H 75/08* (2013.01); *B65H 75/18* (2013.01); *B65H 2403/40* (2013.01)

(58) Field of Classification Search

USPC ..... 242/596, 596.7

See application file for complete search history.

(56) References Cited

U.S. PATENT DOCUMENTS

| | | | | |
|---|---|---|---|---|
| 7,823,825 | B2 * | 11/2010 | Genta | B41J 15/04 242/573 |
| 9,181,058 | B2 * | 11/2015 | Ito | B65H 75/08 |
| 2001/0054667 | A1 * | 12/2001 | Komatsu | B65H 75/08 242/596.1 |
| 2011/0076083 | A1 * | 3/2011 | Tsurui | B65H 19/126 400/611 |
| 2012/0032021 | A1 * | 2/2012 | Morinaga | B65H 75/08 242/577 |
| 2015/0069169 | A1 * | 3/2015 | Hashiuchi | B65H 19/126 242/533 |
| 2015/0091997 | A1 | 4/2015 | Ito | |
| 2016/0130110 | A1 * | 5/2016 | Honda | B65H 75/242 242/574 |
| 2018/0257902 | A1 * | 9/2018 | Honda | B65H 75/18 |
| 2019/0291995 | A1 * | 9/2019 | Akahane | B65H 75/30 |
| 2020/0039256 | A1 * | 2/2020 | Nakayama | B41J 15/042 |
| 2020/0247153 | A1 * | 8/2020 | Oda | B65H 75/10 |

FOREIGN PATENT DOCUMENTS

JP 2015-067415 A 4/2015

* cited by examiner

*Primary Examiner* — William A. Rivera

(74) *Attorney, Agent, or Firm* — Workman Nydegger

(57) ABSTRACT

A medium supporting device including a support part configured to support a roll body on which a sheet shaped medium is wound, a shaft serving as a rotary axis of the roll body and secured with the support part, and a driver configured to rotate the roll body supported by the support part. The shaft is secured to the support part by using a metal plate having a flat surface provided with an insertion hole, the insertion hole being a hole into which the shaft is inserted. An outer circumference part of the metal plate is restricted from moving in a rotation direction of the roll body relative to an inner circumference part of the support part.

8 Claims, 13 Drawing Sheets

MEDIUM SUPPORTING DEVICE AND RECORDING DEVICE

BACKGROUND

1. Technical Field

The invention relates to a medium supporting device and a recording device.

2. Related Art

Various medium supporting devices have been used. Some medium supporting devices are configured to support a roll body on which a sheet shaped medium is wound. Such medium supporting devices varying in configuration have been disclosed.

For example, JP-A-2015-67415 discloses a core tube holding device (medium supporting device) configured to support a rolled target recording medium (roll body on which a sheet shaped medium is wound). The core tube holding device disclosed in JP-A-2015-67415 includes a flange (support part) configured to support the rolled target recording medium, and a shaft serving as a rotary axis of the rolled target recording medium and secured with the flange.

In the known medium supporting device disclosed in JP-A-2015-67415, the support part and the shaft are secured by a securing part having a bent part. For example, in JP-A-2015-67415, a pressing part that is a vessel member (metal box) having the bent part is used to secure the flange (support part) and the shaft.

When a large, heavy roll body is used in the medium supporting device configured to secure the support part and the shaft with the securing part having the bent part, for example, a strong force is applied to the bent part, changing a degree of bending on the bent part. As a result, the support part may deform, e.g., twist, relative to the shaft. That is, when the support part deforms relative to the shaft, accuracy in feeding of a medium may lower.

SUMMARY

An advantage of some aspects of the invention is to suppress a support part configured to support a roll body on which a sheet shaped medium is wound from deforming relative to a shaft.

To solve the issue described above, a medium supporting device according to a first aspect of the invention includes a support part configured to support a roll body on which a sheet shaped medium is wound, and a shaft serving as a rotary axis of the roll body and secured with the support part, and a driver configured to rotate the roll body supported by the support part. The shaft is secured to the support part by using a metal plate having a flat surface provided with an insertion hole, the insertion hole being a hole into which the shaft is inserted. An outer circumference part of the metal plate is restricted from moving in a rotation direction of the roll body relative to an inner circumference part of the support part.

According to the aspect, the shaft and the support part are secured by using the metal plate having the flat surface provided with the insertion hole inserted with the shaft, and the outer circumference part of the metal plate is restricted from moving in the rotation direction of the roll body relative to the inner circumference part of the support part. That is, as the roll body rotates, a force does not apply in a direction intersecting with the flat surface (direction allowing the force to cause deformation), but applies to the outer circumference part of the metal plate. In other words, the metal plate is configured to receive a force in a direction in which deformation would be less likely to occur. Therefore, the support part can be suppressed from deforming relative to the shaft.

In a medium supporting device according to a second aspect of the invention, in the first aspect, the outer circumference part of the metal plate is provided with a plurality of teeth, and the inner circumference part of the support part is provided with a plurality of engaging parts, each of which engaging with a respective tooth of the plurality of teeth.

According to the aspect, the outer circumference part of the metal plate is provided with the plurality of teeth, and the inner circumference part of the support part is provided with the concave and convex part configured to engage with the teeth. With the configuration described above, such a configuration can be easily formed in which the outer circumference part of the metal plate is restricted from moving in the rotation direction of the roll body relative to the inner circumference part of the support part, i.e., the support part and the shaft rotate in synchronization with each other in the rotation direction of the roll body. Such a configuration can be further easily formed in which the metal plate and the support part rotate in synchronization with each other in the rotation direction of the roll body.

In a medium supporting device according to a third aspect of the invention, in the second aspect, gap is formed between the respective tooth of the plurality of teeth and corresponding engage portion of the plurality of engaging parts in a radial direction of the shaft.

For example, when the support part and the metal plate are made of materials different from each other, coefficients of thermal expansion also differ from each other. When the support part and the metal plate having the coefficients of thermal expansion different from each other are in contact with each other at wider areas, the metal plate thermally expands in the radial direction as a temperature changes, whereas the support part might be less likely to change greatly in volume, for example. When this occurs, the metal plate thermally expanded pushes the inner circumference part of the support part in the radial direction. When rigidity of the support part is lower than rigidity of the metal plate, the support part may deform. To deal with this, according to the aspect, the gap is formed between each of the teeth and the concave and convex part in the radial direction of the shaft. Therefore, even when the support part and the metal plate are made of materials different from each other, deformation of the support part due to a change in temperature, for example, can be suppressed.

In a medium supporting device according to a fourth aspect of the invention, in the second or third aspect, the respective engage part of the plurality of the engages parts is formed with a protruding part protruding in a direction along the rotation direction of the roll body, and the protruding part abuts the outer circumference part of the metal plate.

According to the aspect, the concave and convex part is formed with the protruding part protruding in the direction along the rotation direction of the roll body, and the protruding part abuts the outer circumference part of the metal plate. Therefore, when the support part is to be attached to the metal plate, for example, by moving and attaching the support part in an axis direction (direction in which the shaft extends) while collapsing a tip of the protruding part, for example, backlash can be suppressed from occurring on the outer circumference part of the metal plate in the rotation direction of the roll body relative to the inner circumference part of the support part. This makes it possible to increase accuracy in feeding of a medium.

A recording device according to a fifth aspect of the invention includes one of the medium supporting devices according to the first to fourth aspects, and a recording unit configured to perform recording onto the medium.

According to the aspect, the support part configured to support the roll body is suppressed from deforming relative to the shaft, and, accordingly, accuracy in feeding of a medium is also suppressed from lowering. As a result, recording can be performed onto a medium fed at high feeding accuracy.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording device 1 according to an example of the invention will be described in detail with reference to the appended drawings.

EXAMPLE 1

FIGS. 1 to 10

First, an outline of the recording device 1 according to Example 1 will be described with reference to FIG. 1.

Figure 1:
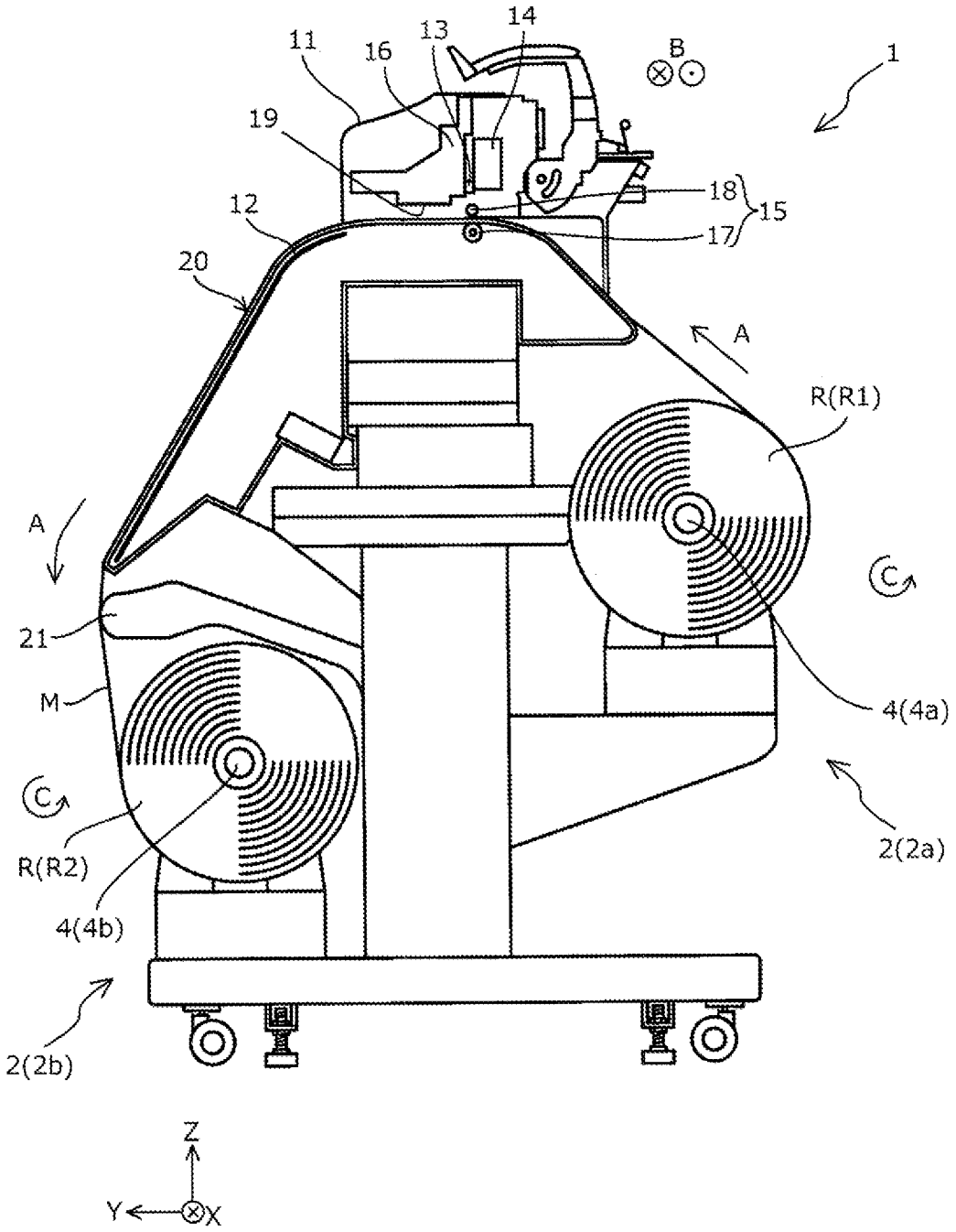
FIG. 1 is a schematic side view of a recording device according to Example 1 of the invention.

FIG. 1 is a schematic perspective view of the recording device 1 according to the example.

Note that, in FIG. 1, some component elements are omitted for clarity of configuration.

In the drawings, an X direction represents a horizontal direction and is a direction in which a shaft 4 of a medium supporting device 2 extends, a Y direction also represents the horizontal direction and is a direction orthogonal to the X direction, and a Z direction represents a perpendicular direction. In the description below, an arrow direction represents a + direction, whereas a direction opposite to the arrow direction represents a − direction. For example, a perpendicular upper direction represents a +Z direction, whereas a perpendicular lower direction represents a −Z direction.

The recording device 1 according to the example includes the medium supporting device 2 (a medium supporting device 2*a* on a feeding side) configured to support a roll body R (a roll body R1 on which a sheet shaped medium M is wound) to undergo recording. In the recording device 1 according to the example, when the medium M is fed in a feeding direction A, the shaft 4 (a shaft 4*a* of the medium supporting device 2*a*) of the medium supporting device 2 rotates in a rotation direction C. The example uses the roll body R1 in which a recording surface to undergo recording faces outward. When using the roll body R1 in which the recording surface faces inward, the shaft 4*a* can be rotated in a direction opposite to the rotation direction C to feed the medium M from the roll body R1.

The recording device 1 according to the example includes a feeding path for the medium M. In the feeding path, a platen 20 configured to support the medium M is provided, for example. The recording device 1 includes a feeding roller pair 15 serving as a feeder including a driving roller 17 and driven rollers 18 for feeding the medium M in the feeding direction A in the feeding path. In the recording device 1 according to the example, the driving roller 17 is a roller extending in an axis direction (a direction in which the shaft 4 extends) B intersecting with the feeding direction A, whereas the driven rollers 18 are a plurality of rollers provided and arranged in the axis direction B to correspond to the driving roller 17 at positions facing the driving roller 17. However, the configuration of the feeder is not limited thereto.

Below the platen 20, a heater 12 is provided as a heating unit configured to heat the medium M supported by the platen 20. As described above, the recording device 1 according to the example includes, as the heating unit, the heater configured to heat the medium M from the platen 20. However, for example, an infrared ray heater may be provided at a position facing a surface of the platen 20. The surface is configured to support the medium M. Further, such a configuration may be adopted that no heating unit is provided.

The recording device 1 according to the example includes, inside the housing 11, a head 19 provided with a plurality of nozzles and configured to allow the nozzles to discharge inks to perform recording, as a recording unit, and a carriage 16 mounted with the head 19 and configured to move back and forth in the axis direction B. In the recording device 1 according to the example, the feeding direction A at a position on the platen 20 facing the head 19 (nozzleformed surface) is a +Y direction, a direction in which the head 19 moves is a direction along the X direction, and a direction in which the inks are to be discharged is the −Z direction (perpendicular lower direction).

Inside the housing 11, a frame 14 and a guide rail 13 attached to the frame 14 and extending in the X direction are formed. The carriage 16 provided with the head 19 is attached to the guide rail 13.

With the configuration described above, the head 19 can move back and forth in the axis direction B intersecting with the feeding direction A, can allow the nozzles to discharge the inks onto the medium M (not illustrated) to be fed, and can perform recording (can form an image). The recording device 1 according to the example can repeat feeding of the medium M in the feeding direction A at a predetermined feeding distance and, when the medium M comes to a halt, moving the head 19 in the axis direction B and discharging the inks to form a desired image onto the medium M.

As for the recording device 1 according to the example, a serial printer configured to repeat feeding of the medium M and allowing the head 19 to perform scanning (to move back and forth) to perform recording is exemplified. However, such a line printer may be used that is configured to use a line head formed with nozzles in a line shape in a width direction of the medium M, to successively feed the medium M, and to successively perform recording.

Downstream of the head 19 in the feeding direction A, the medium supporting device 2 (the medium supporting device 2*b* on a retrieval side) configured to wind the medium M to form the roll body R (a roll body R2 on which the sheet shaped medium M is wound) is provided. In the example, the medium M is to be wound to allow the recording surface to face outward. When the medium M is to be wound, the shaft 4 (a shaft 4*b*) of the medium supporting device 2*b* rotates in the rotation direction C. On the other hand, when winding takes place to allow the recording surface to face inward, the shaft 4*b* can rotate in the direction opposite to the rotation direction C to wind the medium M.

Between the medium supporting device 2*b* and an end part, downstream in the feeding direction A, of the platen 20, a tension bar 21 is provided. The tension bar 21 has a contact part extending in the axis direction B and configured to come into contact with the medium M to apply desired tension to the medium M. However, such a configuration that is not provided with the tension bar 21 may be adopted.

A main part of the recording device 1 according to the example, i.e., the medium supporting device 2, will be described next. In the recording device 1 according to the example, the medium supporting device 2*a* on the feeding side and the medium supporting device 2*b* on the retrieval side are configured in a similar manner, excluding mounting positions, for example. That is, the medium supporting device 2*a* and the medium supporting device 2*b* both correspond to the medium supporting device according to the invention. Therefore, the medium supporting device 2*b* will be described below as an example. However, the description similarly corresponds to the medium supporting device 2*a*.

Figure 2:
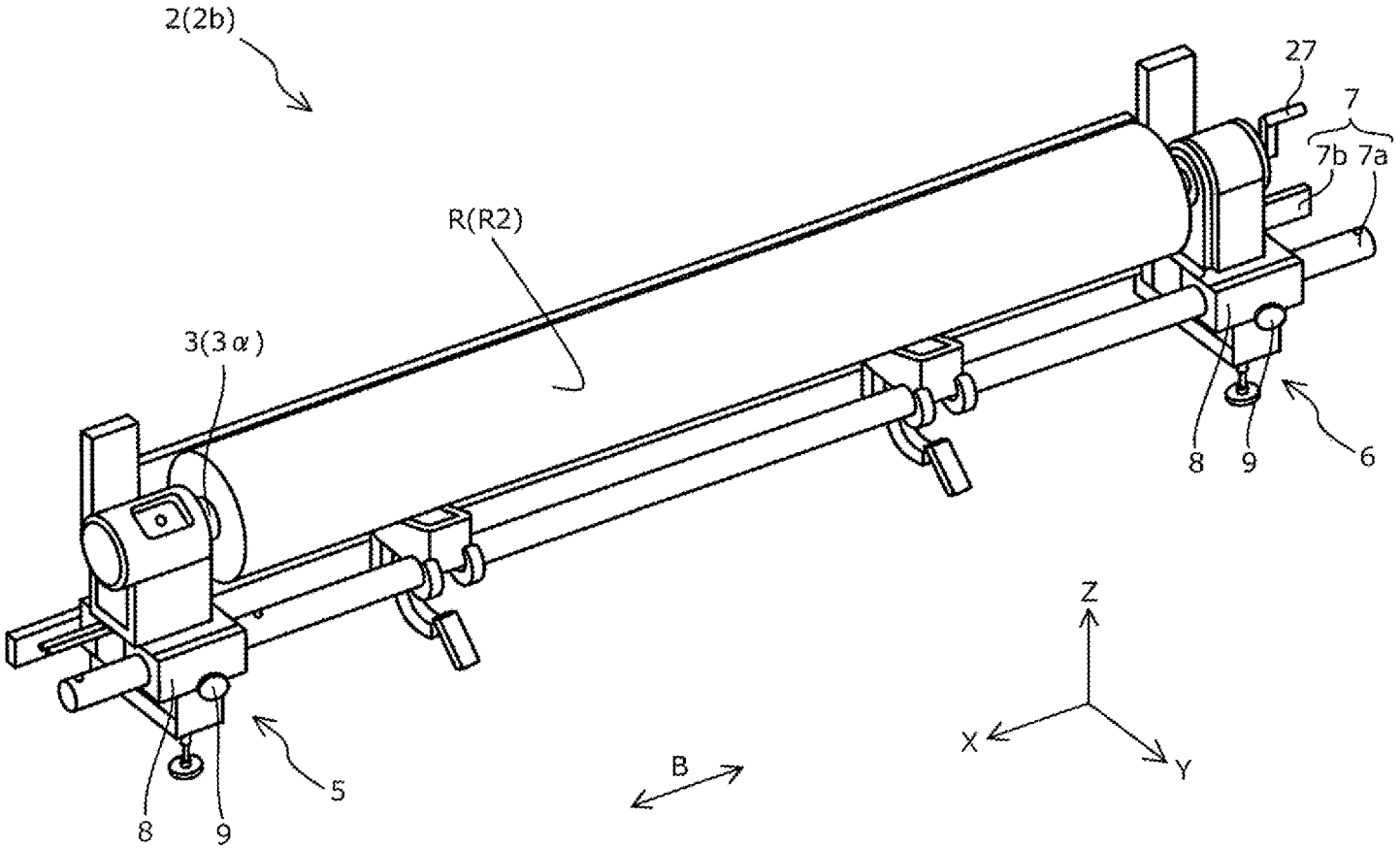
FIG. 2 is a schematic perspective view of a medium supporting device in the recording device according to Example 1 of the invention.
Figure 3:
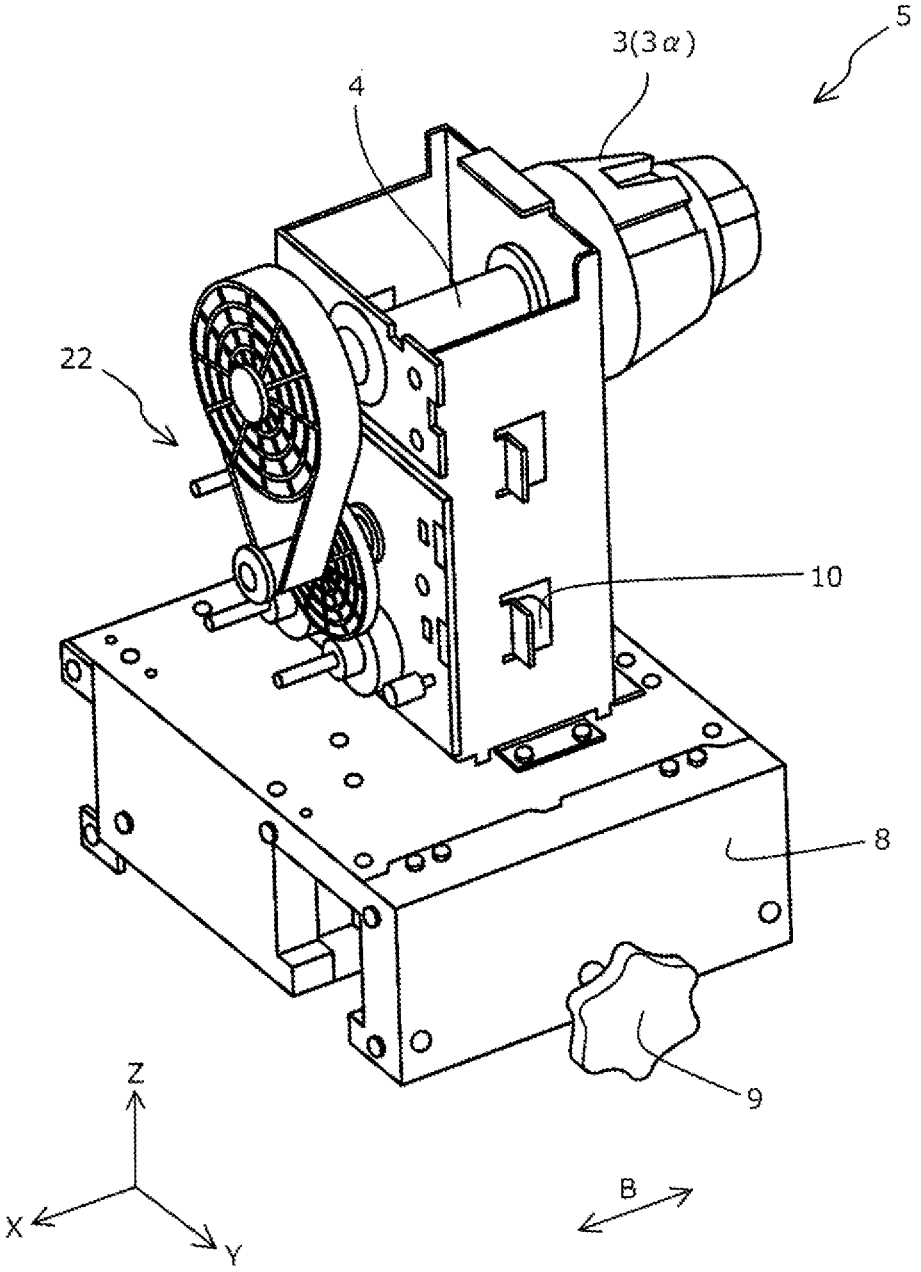
FIG. 3 is a schematic perspective view of a driver side of the medium supporting device in the recording device according to Example 1 of the invention.
Figure 4:
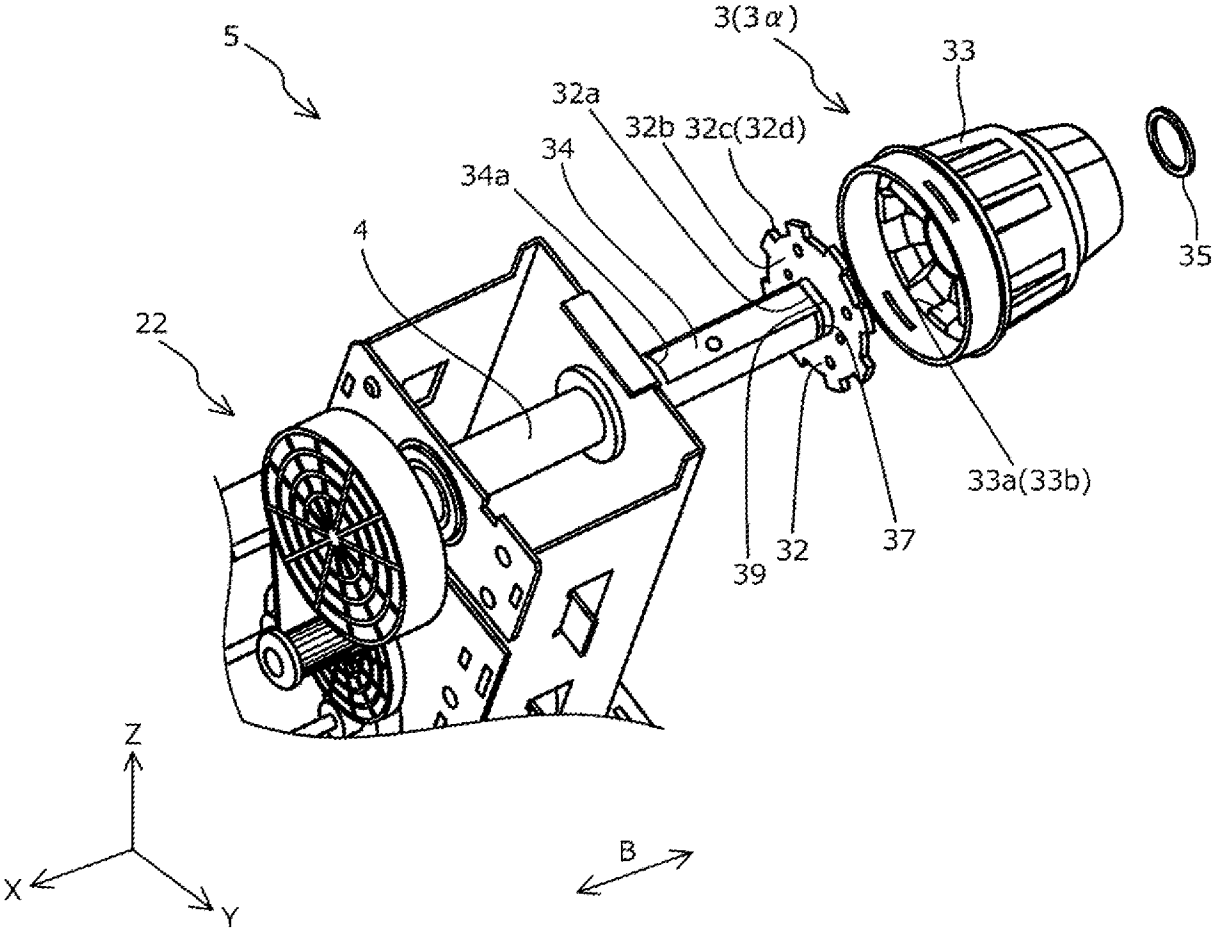
FIG. 4 is a schematic exploded view of the driver side of the medium supporting device in the recording device according to Example 1 of the invention.
Figure 5:
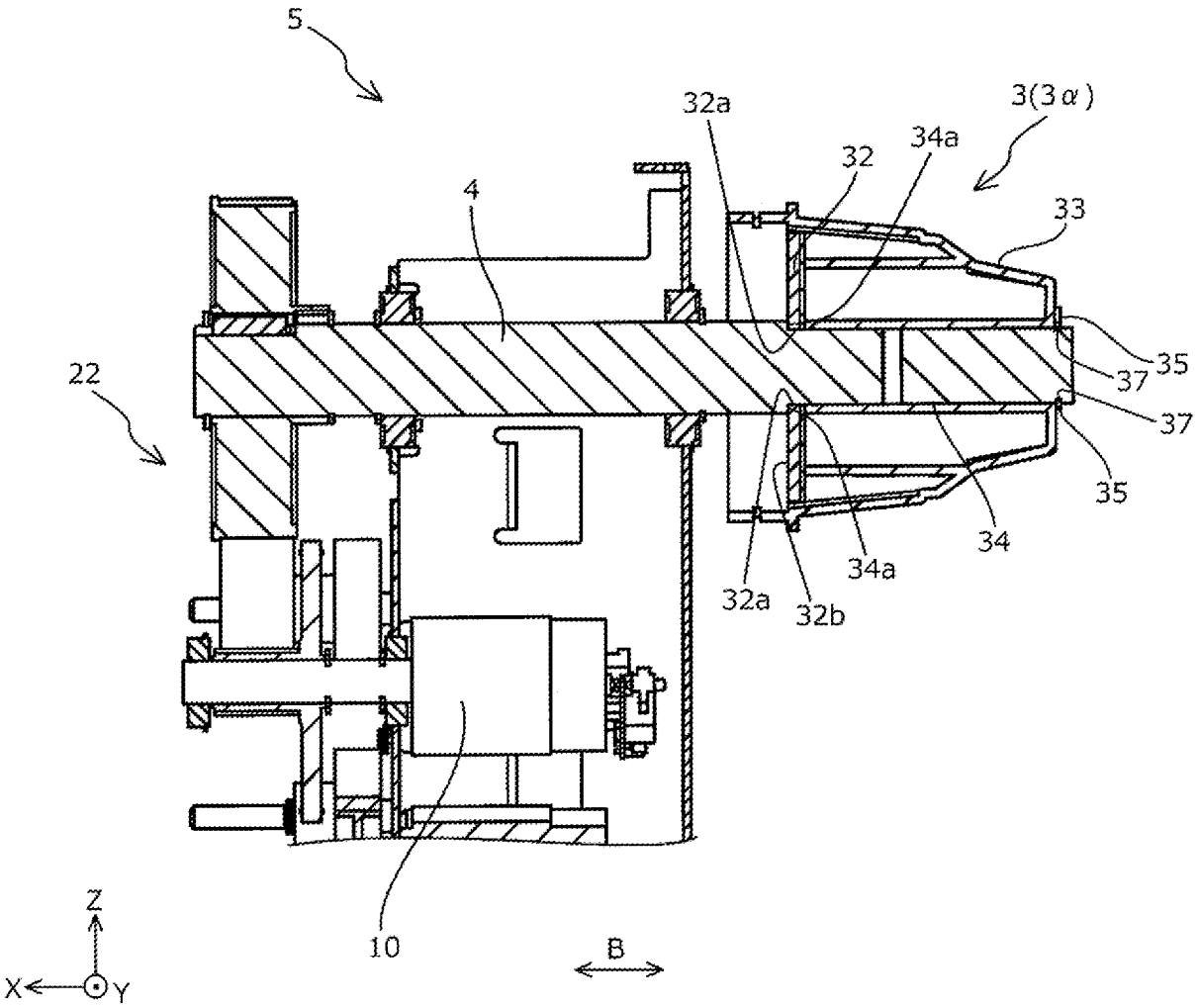
FIG. 5 is a schematic cross-sectional view of the driver side of the medium supporting device in the recording device according to Example 1 of the invention.
Figure 6:
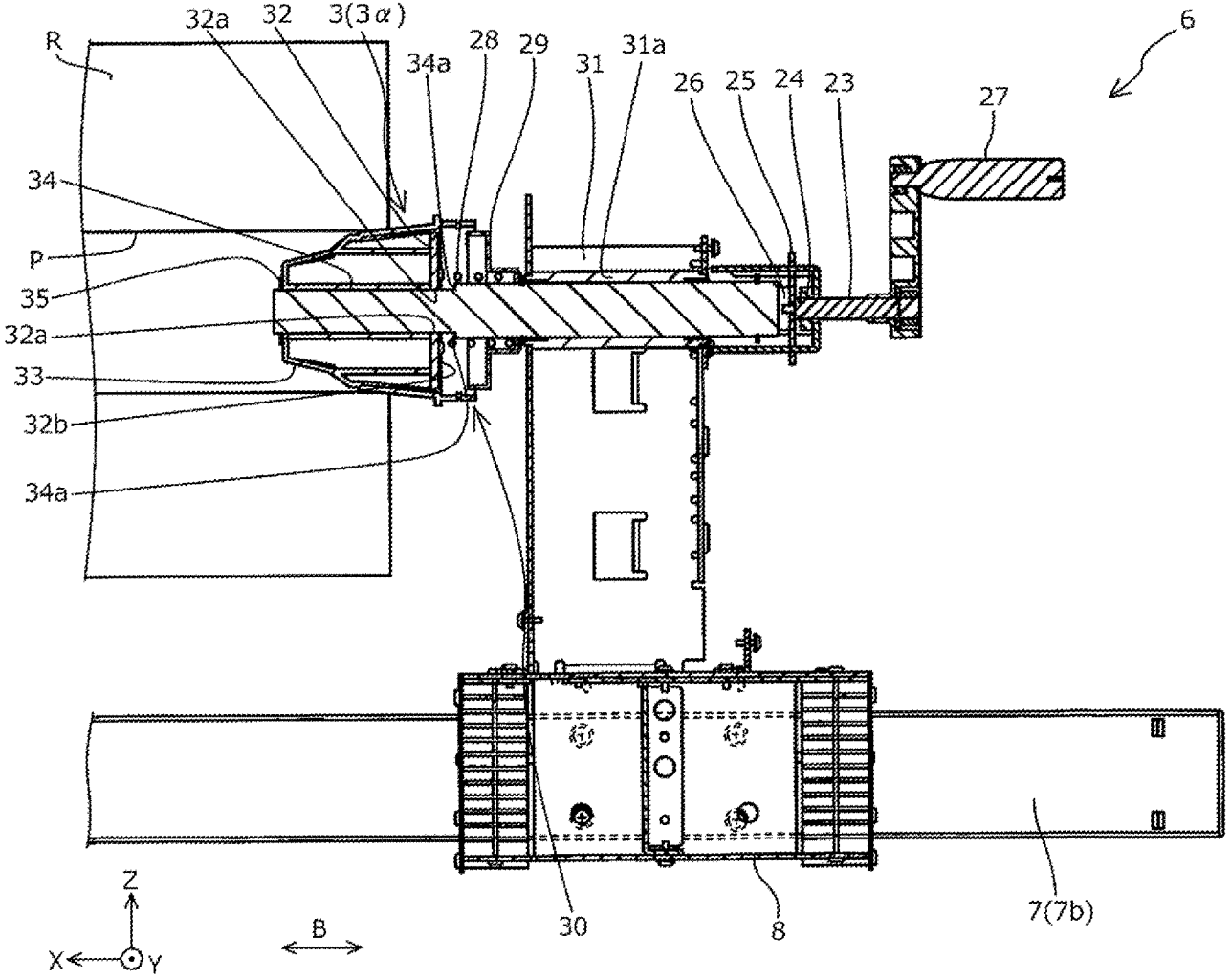
FIG. 6 is a schematic cross-sectional view of a driven side of the medium supporting device in the recording device according to Example 1 of the invention.
Figure 7:
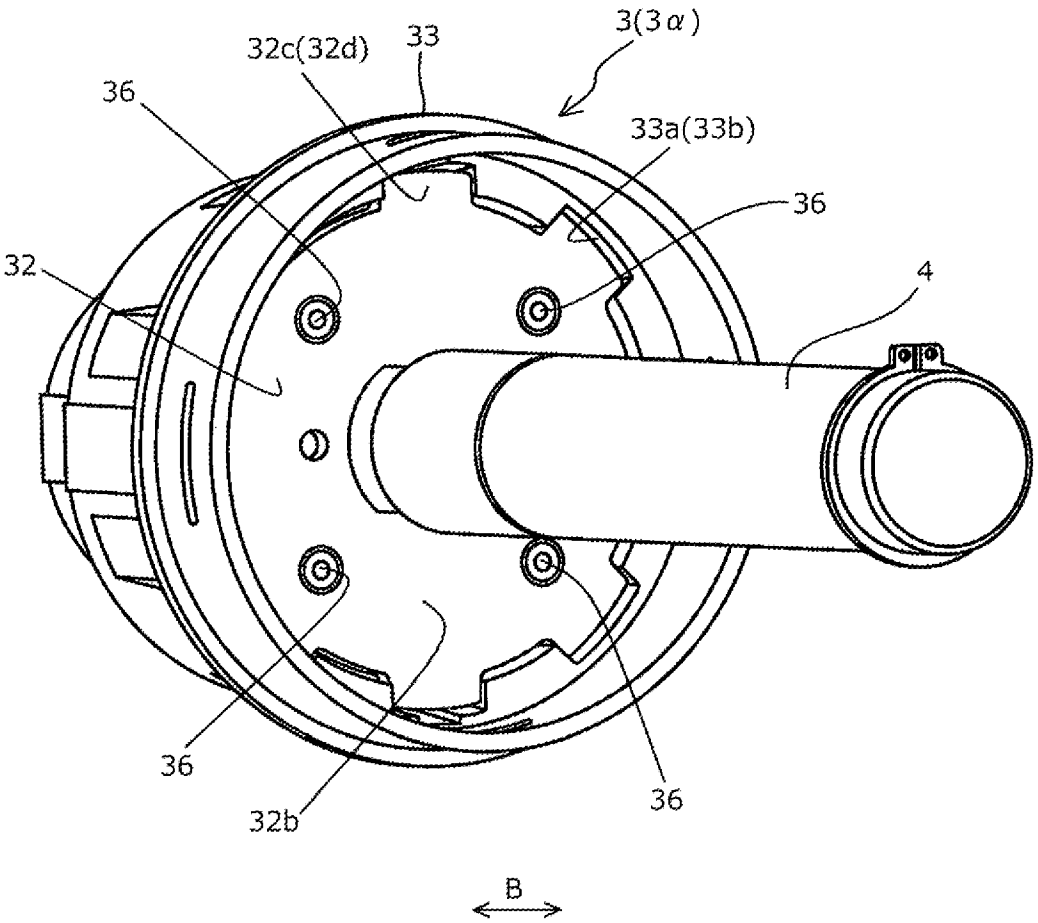
FIG. 7 is a schematic perspective view illustrating a support part and a shaft of the medium supporting device in the recording device according to Example 1 of the invention.
Figure 8:
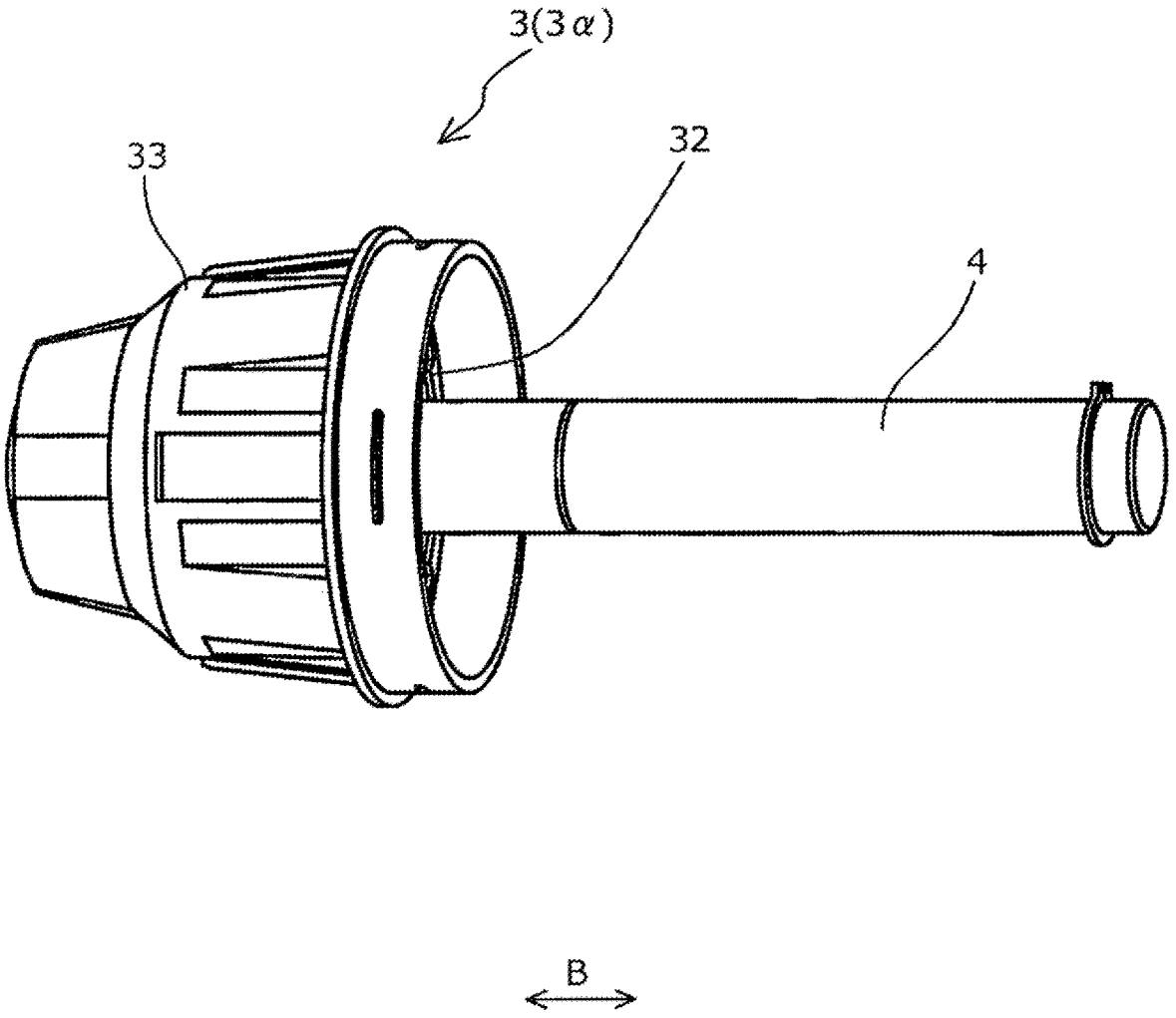
FIG. 8 is a schematic perspective view illustrating the support part and the shaft of the medium supporting device in the recording device according to Example 1 of the invention.
Figure 9:
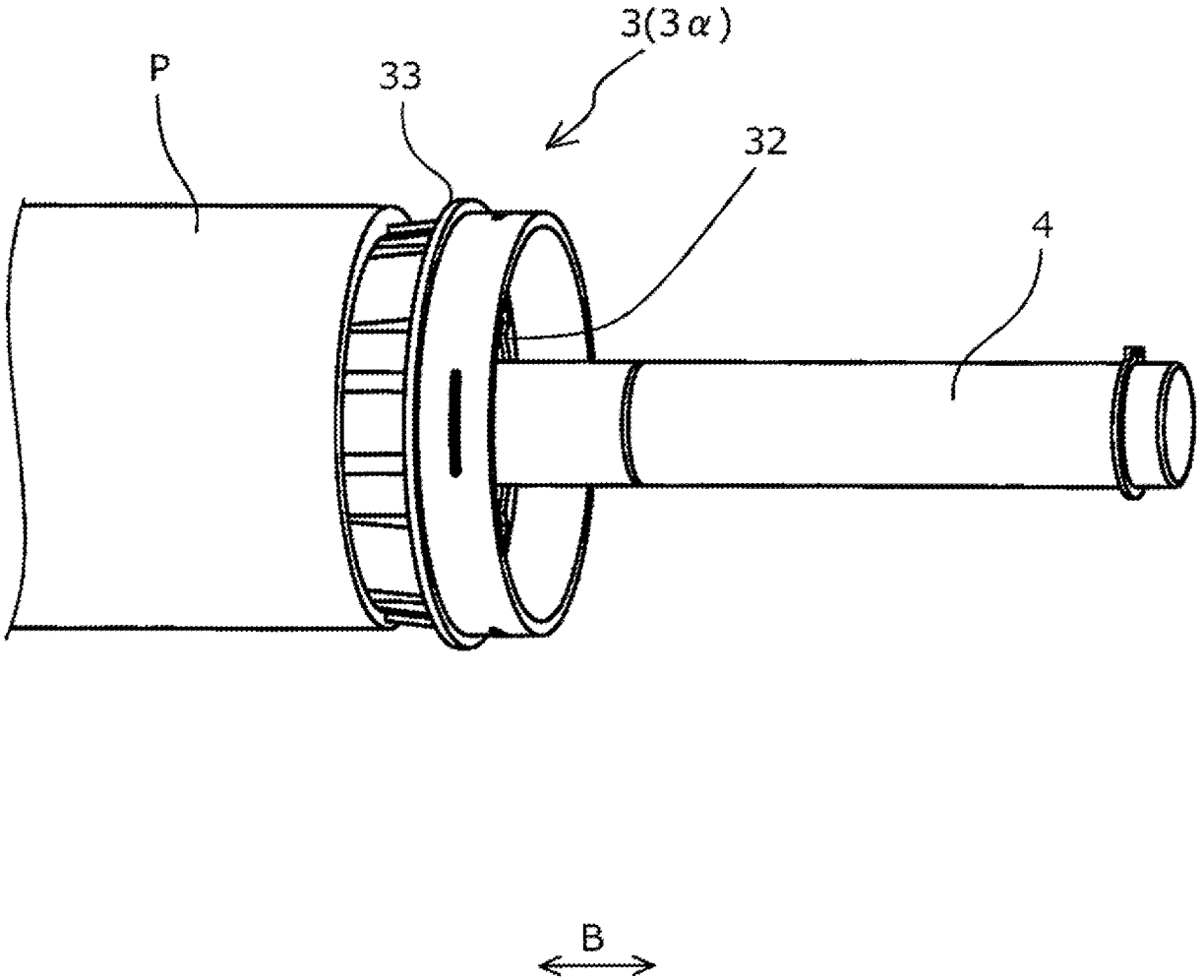
FIG. 9 is a schematic perspective view illustrating the support part and the shaft of the medium supporting device in the recording device according to Example 1 of the invention.
Figure 10:
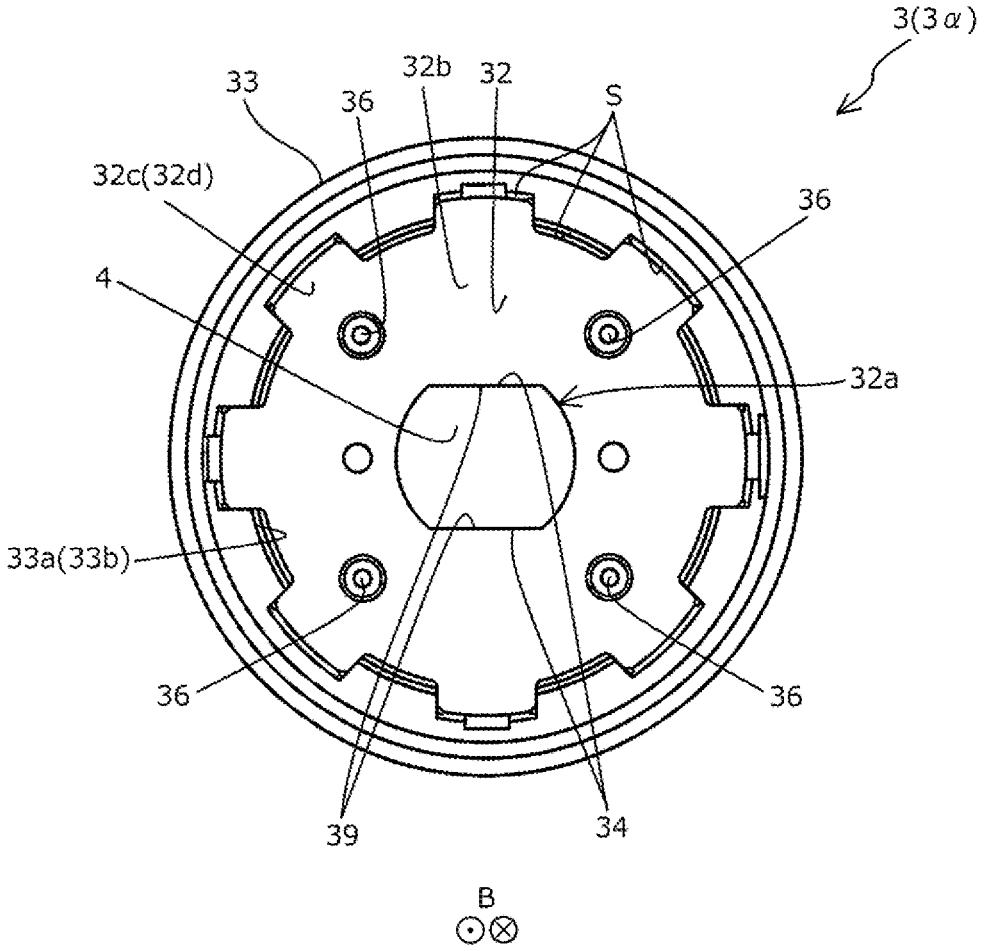
FIG. 10 is a schematic side view illustrating the support part and the shaft of the medium supporting device in the recording device according to Example 1 of the invention.

FIG. 2 is a schematic perspective view of the medium supporting device 2 (medium supporting device 2*b*) in the recording device 1 according to the example. FIG. 3 is a schematic perspective view of a driver-side support unit 5 of the medium supporting device 2 according to the example. FIG. 4 is a schematic exploded view of the driver-side support unit 5 of the medium supporting device 2 according to the example. FIG. 5 is a schematic cross-sectional view of the driver-side support unit 5 of the medium supporting device 2 according to the example. FIG. 6 is a schematic cross-sectional view of a driven-side support unit 6 of the medium supporting device 2 according to the example. FIG. 7 is a schematic perspective view illustrating a support part 3 (support part 3α) and the shaft 4 of the medium supporting device 2 according to the example. FIGS. 8 and 9 are schematic perspective views illustrating the support part 3 and the shaft 4 of the medium supporting device 2 according to the example. FIG. 8 illustrates a state where a paper tube P of the roll body R is not fitted to the support part 3. FIG. 9 illustrates a state where the paper tube P of the roll body R is fitted to the support part 3. FIG. 10 is a schematic side view illustrating the support part 3 of the medium supporting device 2 according to the example.

Figure 12:
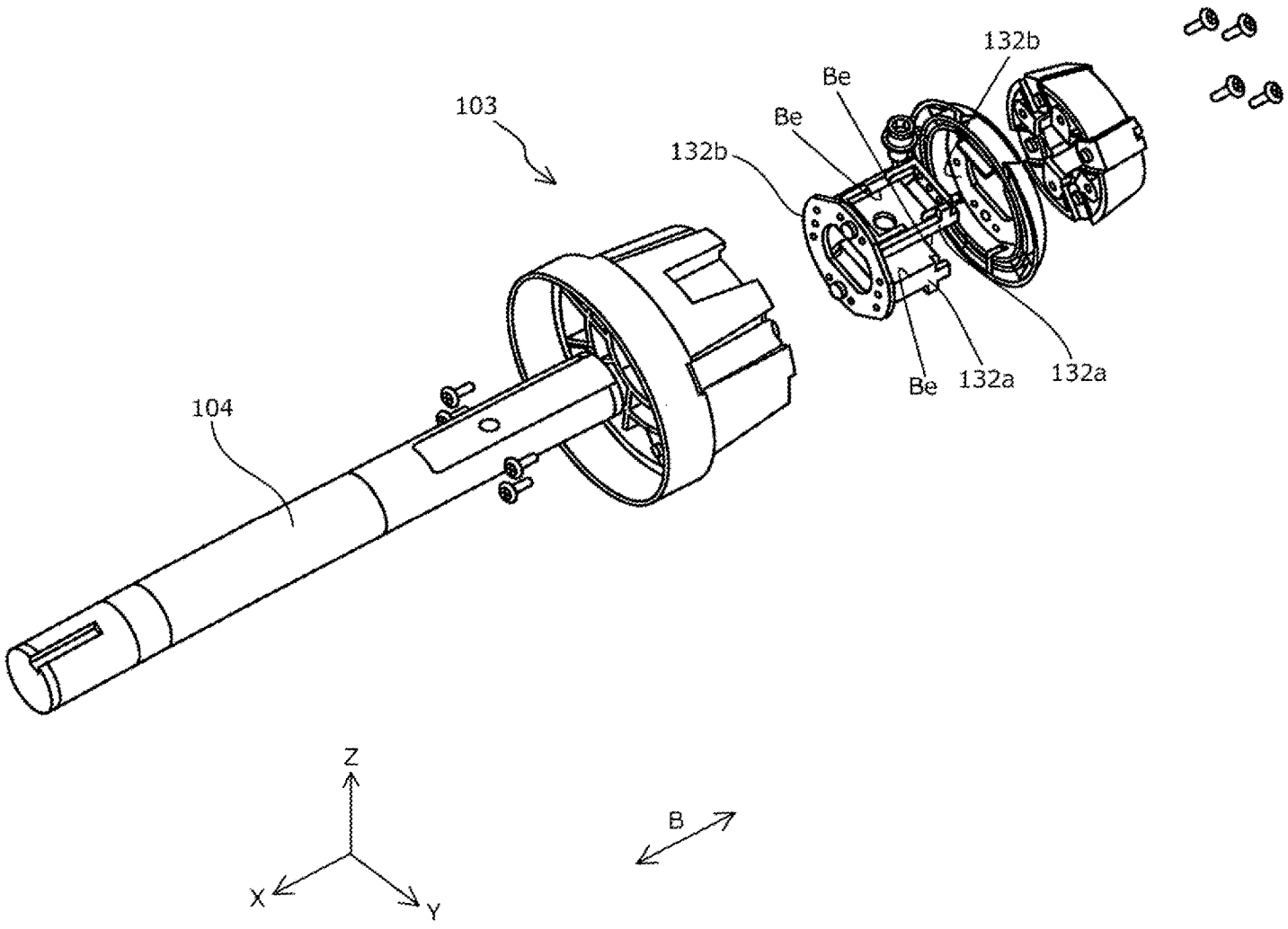
FIG. 12 is a schematic exploded view illustrating a support part and a shaft of a medium supporting device in a recording device according to a reference example.
Figure 13:
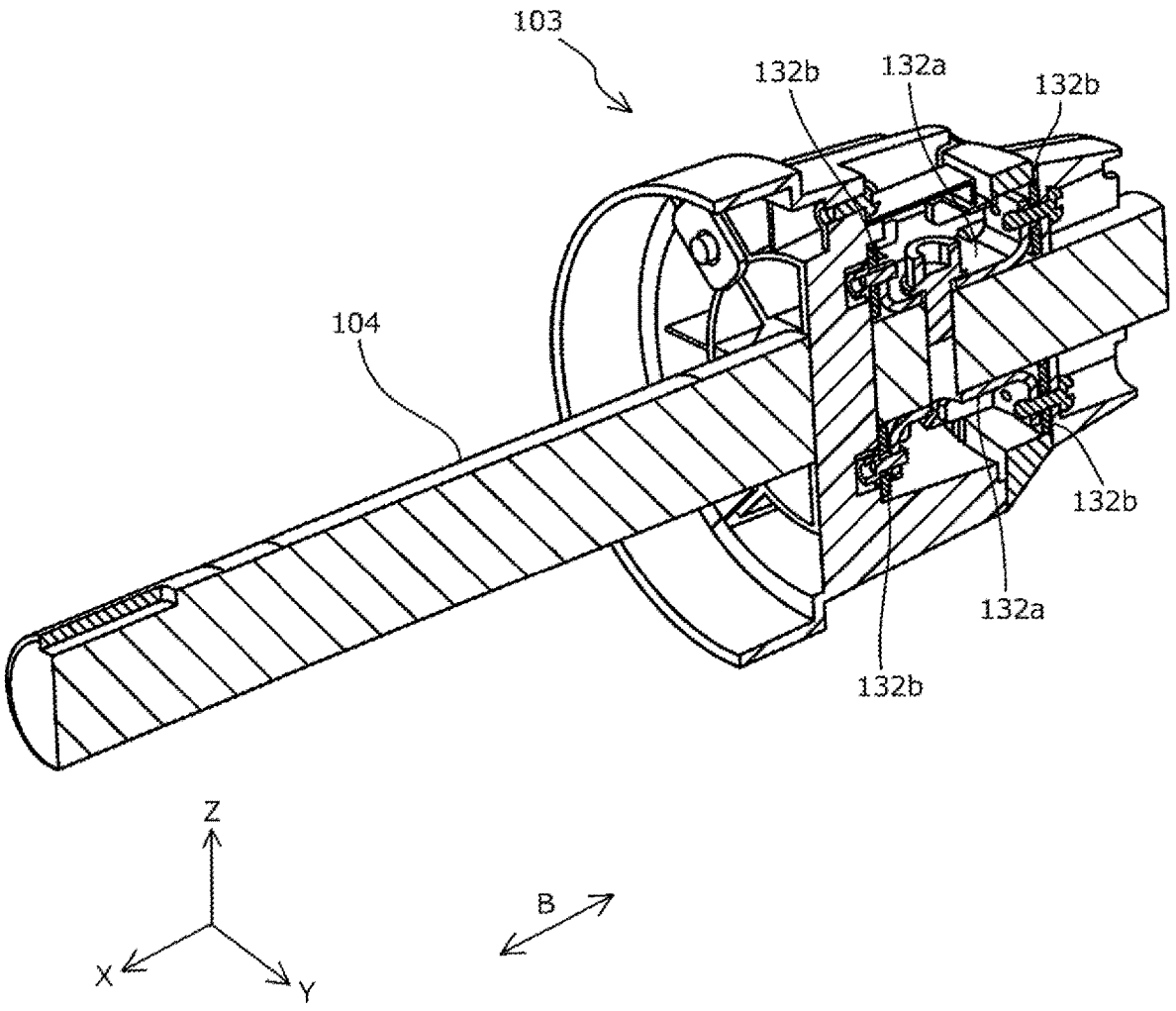
FIG. 13 is a schematic cross-sectional view illustrating the support part and the shaft of the medium supporting device in the recording device according to the reference example.

FIG. 12 is a schematic exploded view illustrating a support part 103 and a shaft 104 of a medium supporting device in a recording device according to a reference example. FIG. 13 is a schematic cross-sectional view illustrating the support part 103 and the shaft 104 of the medium supporting device in the recording device according to the reference example.

Note that, in FIGS. 2 to 10, 12, and 13, similar to FIG. 1, some component elements may be omitted as required for clarity of configuration.

The medium supporting device 2 according to the example includes the driver-side support unit 5 including the support part 3 and the shaft 4 illustrated in FIGS. 3 to 5 on a driver side in the axis direction B, and the driven-side support unit 6 including the support part 3 and the shaft 4 illustrated in FIG. 6 on a driven side in the axis direction B (see FIG. 2). The paper tube P of the roll body R is fitted to the support part 3 of the driver-side support unit 5 (see FIG. 9). The paper tube P of the roll body R is further fitted to the support part 3 of the driven-side support unit 6. As illustrated in FIG. 2, both sides, in the axis direction B, of the roll body R are thus pinched and supported.

As illustrated in FIG. 2, the driver-side support unit 5 and the driven-side support unit 6 each include an insertion part 8 inserted into a rail 7 (a rail 7*a* and a rail 7*b*) extending in the axis direction B. The driver-side support unit 5 and the driven-side support unit 6 are both configured to move along the rail 7 (axis direction B) when locking bulbs 9 each formed on the insertion part 8 are loosened. The medium supporting device 2 according to the example configured as described above allows the driver-side support unit 5 and the driven-side support unit 6 to be arranged at appropriate positions to support the roll body R (medium M) varying in width.

As illustrated in FIGS. 3 to 5, for example, the driver-side support unit 5 includes the support part 3 configured to support the roll body R, the shaft 4 secured with the support part 3, the insertion part 8 configured to be inserted with the rail 7, and a motor 10 serving as a driver configured to rotate the roll body R. A driving force of the motor 10 is transmitted, via a power transmission mechanism 22 including a plurality of gears and a belt, for example, to the shaft 4, transmitted via the shaft 4 to the support part 3, and further transmitted via the support part 3 to the roll body R.

As illustrated in FIG. 6, the driven-side support unit 6 includes an insertion part 31 provided with an insertion hole 31*a* inserted with the shaft 4 secured with the support part 3. An end (−X direction side) of the insertion part 31 is formed with a lever 27 provided with a male screw 23. Another end (+X direction side) of the insertion part 31 is provided with a spring 28 and a spring seat 29. When the roll body R is set (when the paper tube P is fitted to the support part 3), the spring 28 pushes the support part 3 in the +X direction, whereby the shaft 4 (i.e., support part 3) inserted into the insertion part 31 is pushed in the +X direction.

As illustrated in FIG. 6, the male screw 23 is fitted to a female screw 24. When the lever 27 is turned via a wear-resistant sheet 25 and a spacer 26, a position of the shaft 4 can be moved in the axis direction B relative to the insertion part 31. In other words, by turning the lever 27, the support part 3 can be moved together with the shaft 4 in the +X direction. The support part 3 can thus be pushed into the paper tube P (the support part 3 can be fully secured to the paper tube P, and the spring 28 can appropriately apply spring pressure). The driven-side support unit 6 according to the example is formed with a push-in amount mark 30 used to check how much the support part 3 is pushed into the driven-side support unit 6 (specifically, the spring seat 29).

With the driver-side support unit 5 and the driven-side support unit 6 configured as described above in the medium supporting device 2 according to the example, the roll body R can be set easily and precisely by following a procedure described below.

First, the driver-side support unit 5 is moved and positioned in the axis direction B relative to the rail 7, and the locking bulbs 9 are tightened and secured. Next, the paper tube P of the roll body R (specifically, an end part on the +X direction side) is set (fitted) onto the support part 3 of the driver-side support unit 5. Next, the driven-side support unit 6 is moved in the axis direction B relative to the rail 7, the paper tube P of the roll body R (specifically, an end part on the −X direction side) is set (fitted) onto the support part 3 of the driven-side support unit 6, and the locking bulbs 9 are tightened and secured. Finally, while checking the push-in amount mark 30, the lever 27 is turned to fully push the support part 3 of the driven-side support unit 6 to an appropriate position relative to the paper tube P of the roll body R. With the procedure described above, the roll body R can be set (secured) at an appropriate position in the medium supporting device 2 (position at which appropriate spring pressure is applied from the driven-side support unit 6 to the roll body R in a direction along the axis direction B).

Next, the securing part between the support part 3 and the shaft 4 in the medium supporting device 2 according to the example will be described in detail with reference to FIGS. 4 to 10, and with reference to FIGS. 12 and 13 illustrating a recording device (medium supporting device) according to a reference example.

In the medium supporting device 2 according to the example, the securing part between the support part 3 and the shaft 4 in the driver-side support unit 5 and the securing part between the support part 3 and the shaft 4 in the driven-side support unit 6 are configured to be substantially identical to each other. FIGS. 4 and 5 illustrate the securing part in the driver-side support unit 5, whereas FIGS. 6 to 10 illustrate the securing part in the driven-side support unit 6. The securing part between the support part 3 and the shaft 4 in the driver-side support unit 5 and the securing part between the support part 3 and the shaft 4 in the driven-side support unit 6 are configured to be substantially identical to each other. Herein, the securing part is described with reference to detailed drawings as required.

As illustrated in FIGS. 12 and 13, in the medium supporting device according to the reference example, the support part 103 and the shaft 104 are secured by using two flat metal plates 132*b* inserted with the shaft 104, and two metal boxes 132*a* coupled to the two flat metal plates 132*b*. As illustrated in FIG. 12, the metal boxes 132*a* each have bent parts Be (sides each formed between two surfaces adjacent to each other and extending in the axis direction B). In such a medium supporting device configured to secure the support part 103 and the shaft 104 with the securing part having the bent parts Be as the medium supporting device according to the reference example, when a large, heavy roll body R is used, a strong force applies to the bent parts Be, changing degrees of bending on the bent parts Be. As a result, the support part 103 may deform, e.g., twist, relative to the shaft 104.

On the other hand, as illustrated in FIGS. 4 to 10, in the medium supporting device 2 according to the example, the support part 3 and the shaft 4 are secured by using a flat metal plate 32 having a flat surface 32*b* provided with an insertion hole 32*a* inserted with the shaft 4. Specifically, as illustrated in FIGS. 7 and 10, for example, the metal plate 32 is wholly formed with a plurality of teeth 32*d* over an outer circumference part 32*c* of the metal plate 32, whereas an inner circumference part 33*a* of a flange 33 of the support part 3 is wholly formed with concave and convex part 33*b* as an engaging part, and which is configured to engage with each of the teeth 32*d*. With the teeth 32*d* and the concave and convex part 33*b*, the outer circumference part 32*c* of the metal plate 32 is restricted from moving in a rotation direction of the roll body R relative to the inner circumference part 33*a* of the flange 33 of the support part 3.

In summary, the medium supporting device 2 according to the example includes the support part 3 configured to support the roll body R sheet shaped medium on which a sheet shaped medium is wound, the shaft 4 serving as the rotary axis of the roll body R and secured with the support part 3, and the motor 10 serving as a driver configured to rotate the roll body R supported by the support part 3.

The shaft 4 and the support part 3 are secured by using the flat metal plate 32 having the flat surface 32*b* provided with the insertion hole 32*a* inserted with the shaft 4. The outer circumference part 32*c* of the metal plate 32 is restricted from moving in the rotation direction of the roll body R relative to the inner circumference part 33*a* of the support part 3.

That is, in the medium supporting device 2 according to the example, as the roll body R rotates, a force does not apply in a direction intersecting with the flat surface 32*b* (direction allowing the force to cause deformation on the flat metal plate 32), but applies along the outer circumference part 32*c* of the metal plate 32 and substantially parallel to the flat surface 32*b*. In other words, in the medium supporting device 2 according to the example, the metal plate 32 is configured to receive a force in a direction in which deformation would be less likely to occur. Therefore, in the medium supporting device 2 according to the example, the support part 3 can be suppressed from deforming relative to the shaft 4. The metal plate 32 can transmit a driving force of the motor 10 to the support part 3 at locations away from the shaft 4 in a radial direction of the shaft 4. Therefore, driving torque for the support part 3 can be relatively increased. Without having bent parts, the metal plate 32 would be less likely to deform, suppressing durability from lowering, compared with the medium supporting device according to the reference example including the bent parts.

When the above description is given in terms of the recording device, the recording device 1 according to the example includes the medium supporting devices 2 described above, and the head 19 serving as a recording unit configured to perform recording onto the medium M. As described above, with the medium supporting device 2 according to the example, the support part 3 configured to support the roll body R is suppressed from deforming relative to the shaft 4, and, accordingly, accuracy in feeding of the medium M is suppressed from lowering. Therefore, in the recording device 1 according to the example, recording can be performed onto the medium M fed at high feeding accuracy.

In the recording device 1 according to the example, the medium supporting device 2*a* on the feeding side and the medium supporting device 2*b* on the retrieval side both correspond to the medium supporting device 2 described above. That is, "the roll body R on which the sheet shaped medium M is wound" denotes not only a roll body on which the sheet shaped medium M is wound to be used for recording, but also a roll body on which the medium M having undergone recording is wound. The invention is not limited to the recording device 1 according to the example. Either of a medium supporting device on the feeding side and a medium supporting device on the retrieval side may differ in configuration from the medium supporting device 2 described above. For example, by applying the medium supporting device 2*a* described above lying upstream of the head 19 in the feeding direction A, the head 19 can perform printing onto the medium M, while accuracy in feeding of the medium M is suppressed from lowering.

In each of the driver-side support unit 5 and the driven-side support unit 6 in the medium supporting device 2 according to the example, the shaft 4 and the support part 3 are secured by using the metal plate 32 having the flat surface 32*b* provided with the insertion hole 32*a* inserted with the shaft 4, restricting the outer circumference part 32*c* of the metal plate 32 from moving in the rotation direction of the roll body R relative to the inner circumference part 33*a* of the support part 3. Nevertheless, the invention is not limited to the medium supporting device 2 according to the example. That is, in at least either of the driver-side support unit 5 and the driven-side support unit 6, the shaft 4 and the support part 3 may be secured by using the metal plate 32 having the flat surface 32*b* provided with the insertion hole 32*a* inserted with the shaft 4, and the outer circumference part 32*c* of the metal plate 32 may be restricted from moving in the rotation direction of the roll body R relative to the inner circumference part 33*a* of the support part 3.

As illustrated in FIG. 4, for example, the shaft 4 has flat surface parts 34, and the insertion hole 32*a* has straight parts 39 corresponding to the flat surface parts 34 (see FIG. 10). As a driving force of the motor 10 causes the shaft 4 inserted into the insertion hole 32*a* to rotate, the flat surface parts 34 and the straight parts 39 come into contact with each other, and the metal plate 32 (support part 3) rotates. As the metal plate 32 according to the example is a flat plate, the securing part has been easily formed between the shaft 4 and the support part 3.

In the medium supporting device 2 according to the example, the shaft 4 is inserted into the metal plate 32, and then further inserted into the flange 33. After that, a fitting member 35 (see FIG. 4) is fitted into a fitting groove 37 (see FIG. 4) formed on an end part of the shaft 4, and screws 36 (see FIGS. 7 and 10) are tightened to secure the metal plate 32 to the flange 33. The support part 3 is thus secured to the shaft 4. However, the invention is not limited to the configuration as described in the example, as long as such a configuration is adopted that the shaft 4 and the support part 3 are secured by using the metal plate 32 having the flat surface 32*b* provided with the insertion hole 32*a* inserted with the shaft 4, and the outer circumference part 32*c* of the metal plate 32 is restricted from moving in the rotation direction of the roll body R relative to the inner circumference part 33*a* of the support part 3.

As described above, the outer circumference part 32*c* of the metal plate 32 is provided with the plurality of teeth 32*d*, whereas the inner circumference part 33*a* of the support part 3 is provided with the concave and convex part 33*b* configured to engage with the teeth 32*d*. With the medium supporting device 2 according to the example configured as described above, such a configuration is easily formed that the outer circumference part 32*c* of the metal plate 32 is restricted from moving in the rotation direction of the roll body R relative to the inner circumference part 33*a* of the support part 3, i.e., the support part 3 and the shaft 4 rotate in synchronization with each other in the rotation direction of the roll body R. Such a configuration can be further easily formed that the metal plate 32 and the support part 3 rotate in synchronization with each other in the rotation direction of the roll body R. Therefore, when a driving force of the motor 10 is applied to the shaft 4, the driving force can be transmitted via the metal plate 32 to the support part 3.

As illustrated in FIG. 10, a gap S is formed between each of the teeth 32*d* and the concave and convex part 33*b* in the radial direction of the shaft 4.

In the medium supporting device 2 according to the example, the support part 3 is made of resin, whereas the metal plate 32 is made of metal. As described above, when the support part 3 and the metal plate 32 are made of materials different from each other, coefficients of thermal expansion of the support part 3 and the metal plate 32 differ from each other. When the support part 3 and the metal plate 32 having the coefficients of thermal expansion different from each other are in contact with each other at wider areas, the metal plate 32 thermally expands in the radial direction as a temperature changes, whereas the support part 3 might be less likely to change greatly in volume, for example. When this occurs, the metal plate 32 thermally expanded pushes the inner circumference part 33*a* of the support part 3 in the radial direction. When rigidity of the support part 3 is lower than rigidity of the metal plate 32, the support part 3 may deform.

To deal with this, in the medium supporting device 2 according to the example, the gap S is formed between each of the teeth 32*d* and the concave and convex part 33*b* in the radial direction of the shaft 4. Even when the support part 3 and the metal plate 32 are made of materials different from each other, for example, deformation of the support part 3 due to a change in temperature can be suppressed.

In the medium supporting device 2 according to the example, the securing part in the driver-side support unit 5 and the securing part in the driven-side support unit 6 differ in configuration in that the metal plate 32 in the driver-side support unit 5 as illustrated in FIG. 5 is in contact with end parts 34*a* inside the flat surface parts 34 (immovable along the axis direction B), whereas the metal plate 32 in the driven-side support unit 6 as illustrated in FIG. 6 is not in contact with the end parts 34*a* inside the flat surface parts 34 (movable along the axis direction B). In other words, the support part 3 in the driver-side support unit 5 does not allow the shaft 4 to rattle in the radial direction of the shaft 4 (does not allow movement in the axis direction B), whereas the support part 3 in the driven-side support unit 6 allows the shaft 4 to rattle in the radial direction of the shaft 4 (allows movement in the axis direction B).

EXAMPLE 2

FIG. 11

Figure 11:
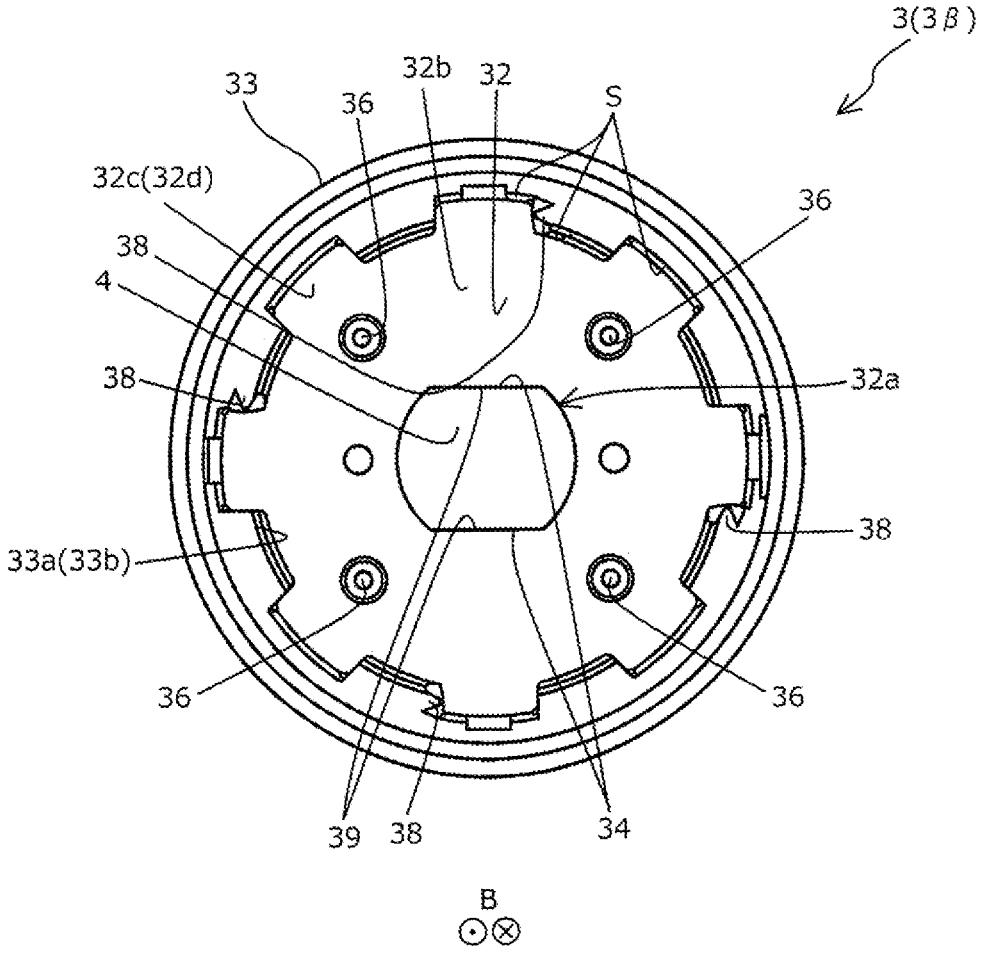
FIG. 11 is a schematic side view illustrating a support part of a medium supporting device in the recording device according to Example 2 of the invention.

FIG. 11 is a schematic side view of a support part 3 (support part 3β) of a medium supporting device 2 in a recording device 1 according to the example, corresponding to FIG. 10 illustrating the support part 3 (support part 3α) in the recording device 1 according to Example 1. Like numbers designate identical or corresponding component elements in Example 1, described above, and detailed description for such component elements are omitted.

The recording device 1 according to the example is similar in configuration to the recording device 1 according to Example 1, excluding a configuration of the support part 3 (specifically, a configuration of a concave and convex part 33*b* in an inner circumference part 33*a* of a flange 33).

As illustrated in FIG. 11, in the medium supporting device 2 according to the example, the concave and convex part 33*b* in the inner circumference part 33*a* of the flange 33 is formed with protruding parts 38 protruding in a direction along the rotation direction of the roll body R. The protruding parts 38 abut the outer circumference part 32*c* of the metal plate 32.

With the medium supporting device 2 according to the example configured as described above, when the support part 3 is to be attached to the metal plate 32, by moving and attaching the support part 3 in the axis direction B while collapsing tips of the protruding parts 38, backlash can be suppressed from occurring on the outer circumference part 32*c* of the metal plate 32 in the rotation direction of the roll body R relative to the inner circumference part 33*a* of the support part 3. This makes it possible to increase accuracy in feeding of a medium.

Note that the invention is not intended to be limited to the aforementioned examples, and many variations are possible within the scope of the invention as described in the appended claims. It goes without saying that such variations also fall within the scope of the invention. For example, the medium supporting devices 2 according to Examples 1 and 2 described above can be applied to other devices than recording devices, such as image readers.

This application claims priority under 35 U.S.C. § 119 to Japanese Patent Application No. 2018-057637, filed Mar. 26 2018. The entire disclosure of Japanese Patent Application No. 2018-057637 is hereby incorporated herein by reference.

What is claimed is:

1. A medium supporting device comprising:

a support part configured to support a roll body on which a sheet shaped medium is wound;

a shaft serving as a rotary axis of the roll body and secured with the support part; and a driver configured to rotate the roll body supported by the support part, wherein the shaft is secured to the support part by using a metal plate having a flat surface provided with an insertion hole, the insertion hole being a hole into which the shaft is inserted, an outer circumference part of the metal plate is restricted from moving in a rotation direction of the roll body relative to an inner circumference part of the support part, the outer circumference part of the metal plate is provided with a plurality of teeth, and the inner circumference part of the support part is provided with a plurality of engaging parts, each of which engaging with a respective tooth of the plurality of teeth.

2. The medium supporting device according to claim 1, wherein a gap is formed between each respective tooth of the plurality of teeth and a corresponding engaging portion of the plurality of engaging parts in a radial direction of the shaft.

3. The medium supporting device according to claim 2, wherein the respective engaging portion of the plurality of engaging parts is formed with a protruding part protruding in a direction along the rotation direction of the roll body, and the protruding part abuts the outer circumference part of the metal plate.

4. A recording device comprising:

the medium supporting device according to claim 3; and a recording unit configured to perform recording onto the medium.

5. The medium supporting device according to claim 2, wherein the respective engaging portion of the plurality of engaging parts is formed with a protruding part protruding in a direction along the rotation direction of the roll body, and the protruding part abuts the outer circumference part of the metal plate.

6. A recording device comprising:

the medium supporting device according to claim 5; and a recording unit configured to perform recording onto the medium.

7. A recording device comprising:

the medium supporting device according to claim 2; and a recording unit configured to perform recording onto the medium.

8. A recording device comprising:

the medium supporting device according to claim 1; and a recording unit configured to perform recording onto the medium.

* * * * *